US010013908B2

(12) United States Patent
Li

(10) Patent No.: US 10,013,908 B2
(45) **Date of Patent: *Jul. 3, 2018**

(54) DISPLAY DEVICES AND DISPLAYING METHODS

(71) Applicant: Shenzhen China Star Optoelectronics Technology Co., Ltd., Shenzhen, Guangdong (CN)

(72) Inventor: Hao Li, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 116 days.

This patent is subject to a terminal disclaimer.

(21) Appl. No.: 14/896,728

(22) PCT Filed: Oct. 27, 2015

(86) PCT No.: PCT/CN2015/092897

§ 371 (c)(1),
(2) Date: Dec. 8, 2015

(87) PCT Pub. No.: WO2017/063227

PCT Pub. Date: Apr. 20, 2017

(65) Prior Publication Data

US 2017/0103696 A1 Apr. 13, 2017

(51) Int. Cl.
*G09G 3/20* (2006.01)

(52) U.S. Cl.
CPC ..... *G09G 3/2074* (2013.01); *G09G 3/2044* (2013.01); *G09G 2300/0452* (2013.01); *G09G 2320/02* (2013.01); *G09G 2340/0428* (2013.01)

(58) Field of Classification Search
None
See application file for complete search history.

(56) References Cited

U.S. PATENT DOCUMENTS

| | | | | |
|---|---|---|---|---|
| 8,599,211 | B2 | 12/2013 | Hsieh et al. | |
| 2010/0238203 | A1 * | 9/2010 | Stroemer | G09G 3/3611 345/690 |
| 2012/0112991 | A1 * | 5/2012 | Hashimoto | G09G 3/3413 345/89 |

(Continued)

FOREIGN PATENT DOCUMENTS

| | | | |
|---|---|---|---|
| CN | 101448163 | A | 6/2009 |
| CN | 103338378 | A | 10/2013 |
| CN | 104732938 | A | 6/2015 |

*Primary Examiner* — Nicholas R Wilson
(74) *Attorney, Agent, or Firm* — Andrew C. Cheng

(57) ABSTRACT

A display device and the displaying method are disclosed. The method includes calculating grayscale degrees of the base-color sub-pixel of the sub-pixels of the current original pixel, selecting a maximum grayscale degree from the grayscale degrees, determining a plurality of weighted factors corresponding to the current sampled pixel of the sampled image in accordance with the maximum grayscale degree, and calculating a weighted sum of grayscale values of the base-color sub-pixels of the current original pixel and the adjacent original pixels by the weighted factors to obtain the grayscale values of the base-color sub-pixels of the current sub-pixel of the current sampled pixel. In this way, the overlapped color issue may be eliminated so as to obtain a clear image.

12 Claims, 3 Drawing Sheets

(56) References Cited

U.S. PATENT DOCUMENTS

| | | | |
|---|---|---|---|
| 2016/0063675 | A1 | 3/2016 | Hu et al. |
| 2016/0343312 | A1 | 11/2016 | Li et al. |
| 2016/0371848 | A1 | 12/2016 | Liu et al. |

* cited by examiner

DISPLAY DEVICES AND DISPLAYING METHODS

BACKGROUND OF THE INVENTION

1. Field of the Invention

The present disclosure relates to display technology, and more particularly to a display device and the displaying method thereof.

2. Discussion of the Related Art

With respect to flat display technology, high resolution contents are displayed on low physical resolution devices to reduce the complexity of the manufacturing process and the manufacturing cost. For instance, the high resolution, i.e., 4K2K, contents are reduced to the low resolution, i.e., 2K1K, and are displayed on the display panel. At the same time, the space resolution rate and the detail definition of the outputted image have to be guaranteed.

Sub-pixel rendering and sub-pixel multiplexing are two good solutions for enhancing the space resolution. With respect to the sub-pixel rendering, the rendering is performed toward the RGBW sub-pixels on each space location of the original pixel, and then the new image is assembled. Such sub-pixel rendering solution is called as direction subpixel-based down-sampling. However, although the DSD sampling method may effectively enhance the space resolution, color may overlap on edge areas of the image, which may cause the image vague.

SUMMARY

The object of the invention is to provide a display device and the displaying method thereof to effectively eliminate overlapped color issue so as to obtain a clear image.

In one aspect, a displaying method of display devices includes: obtaining grayscale values of sub-pixels of a current original pixel and the original pixels adjacent to the current original pixel of an original image; determining whether the current original pixel is a pure-color pixel in accordance with the grayscale values of each of the base-color sub-pixels of the current original pixel; when the current original pixel is the pure-color pixel, the grayscale value of the sub-pixel, which is larger than zero, is selectively filled into the corresponding sub-pixel of a current sampled pixel or a previous sampled pixel in accordance with location of the sub-pixel of the current original pixel having the grayscale value larger than zero and the location of the current sub-pixel of the current sampled pixel; when the current original pixel is not the pure-color pixel, the method further includes: calculating grayscale degrees of the base-color sub-pixel of the sub-pixels of the current original pixel, and selecting a maximum grayscale degree from the grayscale degrees; determining a plurality of weighted factors corresponding to the current sampled pixel of the sampled image in accordance with the maximum grayscale degree; calculating a weighted sum of grayscale values of the base-color sub-pixels of the current original pixel and the adjacent original pixels by the weighted factors to obtain the grayscale values of the base-color sub-pixels of the current sub-pixel of the current sampled pixel; filling the grayscale values of the base-color sub-pixels of the current sub-pixels of the current sampled pixels respectively in the base-color sub-pixels of the current sampled pixels; wherein the current original pixel and the current sampled pixel respectively includes a first sub-pixel, a second sub-pixel, a third sub-pixel and a fourth sub-pixel arranged in sequence, the first sub-pixel, the second sub-pixel, and the third sub-pixel are the base-color sub-pixels, and the fourth sub-pixel is not the base-color sub-pixel, after the step of obtaining the grayscale values of sub-pixels of the current original pixel and the original pixels adjacent to the current original pixel of the original image, the method further includes: selecting the maximum grayscale value from the grayscale values of the fourth sub-pixels of the current original pixel and the adjacent original pixels to obtain the grayscale value of the fourth sub-pixel of the current sampled pixel; and filling the grayscale value of the fourth sub-pixel of the current sampled pixel into the fourth sub-pixel of the current sampled pixel.

Wherein the step of selectively filling the grayscale value of the sub-pixel larger than zero into the corresponding sub-pixel of the current sampled pixel or the previous sampled pixel further includes: when the sub-pixel having the grayscale value larger than zero is the first sub-pixel or the second sub-pixel of the current original pixel and the current sub-pixel is the first sub-pixel or the second sub-pixel of the current sampled pixel, the grayscale values of the first sub-pixel and the second sub-pixel of the current original pixel are fed into the first sub-pixel and the second sub-pixel of the current sampled pixel; when the sub-pixel having the grayscale value larger than zero is the first sub-pixel or the second sub-pixel of the current original pixel and the current sub-pixel is the third sub-pixel or the fourth sub-pixel of the current sampled pixel, the grayscale values of the first sub-pixel and the second sub-pixel of the current original pixel are fed into the first sub-pixel and the second sub-pixel of the current sampled pixel; when the sub-pixel having the grayscale value larger than zero is the third sub-pixel or the fourth sub-pixel of the current original pixel and the current sub-pixel is the third sub-pixel or the fourth sub-pixel of the current sampled pixel, the grayscale values of the third sub-pixel and the fourth sub-pixel of the current original pixel are fed into the third sub-pixel and the fourth sub-pixel of the current sampled pixel; and when the sub-pixel having the grayscale value larger than zero is the third sub-pixel or the fourth sub-pixel of the current original pixel and the current sub-pixel is the first sub-pixel or the second sub-pixel of the current sampled pixel, the grayscale values of the third sub-pixel and the fourth sub-pixel of the current original pixel are fed into the third sub-pixel and the fourth sub-pixel of the previous sampled pixel.

Wherein the current sampled pixel includes at least two sub-pixel sets, the sub-pixel of one of the sub-pixel sets is the current sub-pixel of the current sampled pixel, and the current original pixel corresponds to one sub-pixel set of the current sub-pixel contained by the current sampled pixel.

Wherein the step of calculating grayscale degrees of the base-color sub-pixel of the sub-pixels of the current original pixel includes: calculating the grayscale degrees by the equations listed below.

$$GL_{R_max}=\max\{|R_{i-1}-R_i|,|R_i-R_{i+1}|\}$$

$$GL_{G_max}=\max\{|G_{i-1}-G_i|,|G_i-G_{i+1}|\}.$$

$$GL_{B_max}=\max\{|B_{i-1}-B_i|,|B_i-B_{i+1}|\}$$

Wherein $R_i$, $G_i$, and $B_i$ respectively relates to the grayscale values of the first sub-pixel, the second sub-pixel, and the third sub-pixel of the current original pixel, $R_{i-1}$, $G_{i-1}$, and $B_{i-1}$ respectively relates to the grayscale values of the first sub-pixel, the second sub-pixel, and the third sub-pixel of the previous original pixel adjacent to the current original pixel, $R_{i+1}$, $G_{i+1}$, and $B_{i+1}$ respectively relates to the grayscale values of the first sub-pixel, the second sub-pixel, and the third sub-pixel of the next original pixel adjacent to the current original pixel, the $GL_{R_max}$, $GL_{G_max}$, $GL_{B_max}$ respectively relates to the grayscale degrees of the first sub-pixel, the second sub-pixel, and the third sub-pixel of the current original pixel; the step of selecting the maximum grayscale degree from the grayscale degrees further includes: selecting the maximum grayscale degrees from the $GL_{R_max}$, $GL_{G_max}$, and $GL_{B_max}$ by the equation listed below.

$$GL_{C_max}=\max\{GL_{R_max}, GL_{G_max}, GL_{B_max}\}.$$

Wherein $GL_{C_max}$ relates to the maximum grayscale degree.

Wherein the step of determining a plurality of weighted factors corresponding to the current sampled pixel of the sampled image in accordance with the maximum grayscale degree further includes the following steps.

Defining a parameter $k=GL_{C_max}\in[0,255]$.

Calculating five weighted factors $w_1$, $w_2$, $w_3$, $w_4$, $w_5$ corresponding to the current sampled pixel by the equations listed below.

$$w_1=\lambda_1*f(x).$$

$$w_2=\lambda_2*f(x).$$

$$w_3=\lambda_3*f(x).$$

$$w_4=\lambda_4*f(x).$$

$$w_5=\lambda_5*f(x).$$

Wherein, $f(x)=ax^3+bx^2+cx+d$, $x=k/255\in[0,1]$, a, b, c, and d are fitting coefficients of f(x), and $\lambda_1$, $\lambda_2$, $\lambda_3$, $\lambda_4$, and $\lambda_5$ are weight distribution coefficients.

The step of calculating a weighted sum of grayscale values of the base-color sub-pixels of the current original pixel and the adjacent original pixels by the weighted factors to obtain the grayscale values of the base-color sub-pixels of the current sub-pixel of the current sampled pixel further includes the following steps.

Obtaining the grayscale values of the base-color sub-pixels of the current sub-pixel of the current sampled pixel by the equation listed below.

$$h_o=w_1*h_{i-2}+w_2*h_{i-1}=w_3*h_i+w_4*h_{i+1}+w_5*h_{i+2}.$$

Wherein $h_o$ relates to the grayscale value of the base-color sub-pixel of the current sub-pixel of the current sampled pixel, h relates to the grayscale value of the base-color sub-pixel of the current original pixel, $h_{i-2}$ and $h_{i-1}$ relates to the grayscale values of the base-color sub-pixels of the two previous original pixels adjacent to the current original pixel, and $h_{i+1}$ and $h_{i+2}$ relates to the grayscale values of the base-color sub-pixels of the two next original pixels adjacent to the current original pixel.

In another aspect, a displaying method of display devices includes: obtaining grayscale values of sub-pixels of a current original pixel and the original pixels adjacent to the current original pixel of an original image; calculating grayscale degrees of the base-color sub-pixel of the sub-pixels of the current original pixel, and selecting a maximum grayscale degree from the grayscale degrees; determining a plurality of weighted factors corresponding to the current sampled pixel of the sampled image in accordance with the maximum grayscale degree; calculating a weighted sum of grayscale values of the base-color sub-pixels of the current original pixel and the adjacent original pixels by the weighted factors to obtain the grayscale values of the base-color sub-pixels of the current sub-pixel of the current sampled pixel; and filling the grayscale values of the base-color sub-pixels of the current sub-pixels of the current sampled pixels respectively in the base-color sub-pixels of the current sampled pixels.

Wherein after the step of obtaining grayscale values of sub-pixels of a current original pixel and the original pixels adjacent to the current original pixel of an original image, the method further includes: determining whether the current original pixel is a pure-color pixel in accordance with the grayscale values of each of the base-color sub-pixels of the current original pixel; calculating grayscale degrees of the base-color sub-pixel of the sub-pixels of the current original pixel, and selecting a maximum grayscale degree from the grayscale degrees when the current original pixel is not the pure-color pixel; and when the current original pixel is the pure-color pixel, the grayscale value of the sub-pixel, which is larger than zero, is selectively filled into the corresponding sub-pixel of a current sampled pixel or a previous sampled pixel in accordance with location of the sub-pixel of the current original pixel having the grayscale value larger than zero and the location of the current sub-pixel of the current sampled pixel.

Wherein the current original pixel and the current sampled pixel respectively includes a first sub-pixel, a second sub-pixel, a third sub-pixel and a fourth sub-pixel arranged in sequence, the step of selectively filling the grayscale value of the sub-pixel larger than zero into the corresponding sub-pixel of the current sampled pixel or the previous sampled pixel further includes: when the sub-pixel having the grayscale value larger than zero is the first sub-pixel or the second sub-pixel of the current original pixel and the current sub-pixel is the first sub-pixel or the second sub-pixel of the current sampled pixel, the grayscale values of the first sub-pixel and the second sub-pixel of the current original pixel are fed into the first sub-pixel and the second sub-pixel of the current sampled pixel; when the sub-pixel having the grayscale value larger than zero is the first sub-pixel or the second sub-pixel of the current original pixel and the current sub-pixel is the third sub-pixel or the fourth sub-pixel of the current sampled pixel, the grayscale values of the first sub-pixel and the second sub-pixel of the current original pixel are fed into the first sub-pixel and the second sub-pixel of the current sampled pixel; when the sub-pixel having the grayscale value larger than zero is the third sub-pixel or the fourth sub-pixel of the current original pixel and the current sub-pixel is the third sub-pixel or the fourth sub-pixel of the current sampled pixel, the grayscale values of the third sub-pixel and the fourth sub-pixel of the current original pixel are fed into the third sub-pixel and the fourth sub-pixel of the current sampled pixel; and when the sub-pixel having the grayscale value larger than zero is the third sub-pixel or the fourth sub-pixel of the current original pixel and the current sub-pixel is the first sub-pixel or the second sub-pixel of the current sampled pixel, the grayscale values of the third sub-pixel and the fourth sub-pixel of the current original pixel are fed into the third sub-pixel and the fourth sub-pixel of the previous sampled pixel.

Wherein the current original pixel and the current sampled pixel respectively includes a first sub-pixel, a second sub-pixel, a third sub-pixel and a fourth sub-pixel arranged in sequence, the first sub-pixel, the second sub-pixel, and the third sub-pixel are the base-color sub-pixels, and the fourth sub-pixel is not the base-color sub-pixel, after the step of obtaining the grayscale values of sub-pixels of the current original pixel and the original pixels adjacent to the current original pixel of the original image, the method further includes: selecting the maximum grayscale value from the grayscale values of the fourth sub-pixels of the current original pixel and the adjacent original pixels to obtain the grayscale value of the fourth sub-pixel of the current sampled pixel; and filling the grayscale value of the fourth sub-pixel of the current sampled pixel into the fourth sub-pixel of the current sampled pixel.

Wherein the current original pixel and the current sampled pixel respectively includes a first sub-pixel, a second sub-pixel, a third sub-pixel and a fourth sub-pixel arranged in sequence, the current sampled pixel includes at least two sub-pixel sets, the sub-pixel of one of the sub-pixel sets is the current sub-pixel of the current sampled pixel, and the current original pixel corresponds to one sub-pixel set of the current sub-pixel contained by the current sampled pixel.

Wherein the current original pixel and the current sampled pixel respectively includes a first sub-pixel, a second sub-pixel, a third sub-pixel and a fourth sub-pixel arranged in sequence, wherein the first sub-pixel, the second sub-pixel, the third sub-pixel are base-color sub-pixels, the step of calculating the grayscale degrees of the base-color sub-pixel of the sub-pixels of the current original pixel further includes: calculating the grayscale degrees by the equations listed below.

$$GL_{R_max}=\max\{|R_{i-1}-R_i|,|R_i-R_{i+1}|\}$$

$$GL_{G_max}=\max\{|G_{i-1}-G_i|,|G_i-G_{i+1}|\}.$$

$$GL_{B_max}=\max\{|B_{i-1}-B_i|,|B_i-B_{i+1}|\}$$

Wherein $R_i$, $G_i$, and $B_i$ respectively relates to the grayscale values of the first sub-pixel, the second sub-pixel, and the third sub-pixel of the current original pixel, $R_{i-1}$, $G_{i-1}$, and $B_{i-1}$ respectively relates to the grayscale values of the first sub-pixel, the second sub-pixel, and the third sub-pixel of the previous original pixel adjacent to the current original pixel, $R_{i+1}$, $G_{i+1}$, and $B_{i+1}$ respectively relates to the grayscale values of the first sub-pixel, the second sub-pixel, and the third sub-pixel of the next original pixel adjacent to the current original pixel, the $GL_{R_max}$, $GL_{G_max}$, $GL_{B_max}$ respectively relates to the grayscale degrees of the first sub-pixel, the second sub-pixel, and the third sub-pixel of the current original pixel.

The step of selecting the maximum grayscale degree from the grayscale degrees further includes the following steps.

Selecting the maximum grayscale degrees from the $GL_{R_max}$, $GL_{G_max}$, and $GL_{B_max}$ by the equation listed below.

$$GL_{C_max}=\max\{GL_{R_max},GL_{G_max},GL_{B_max}\}.$$

Wherein $GL_{C_max}$ relates to the maximum grayscale degree.

Wherein the step of determining a plurality of weighted factors corresponding to the current sampled pixel of the sampled image in accordance with the maximum grayscale degree further includes the following steps.

Defining a parameter $k=GL_{C_max}\in[0,255]$.

Calculating five weighted factors $w_1$, $w_2$, $w_3$, $w_4$, $w_5$ corresponding to the current sampled pixel by the equations listed below.

$$w_1=\lambda_1*f(x).$$

$$w_2=\lambda_2*f(x).$$

$$w_3=\lambda_3*f(x).$$

$$w_4=\lambda_4*f(x).$$

$$w_5=\lambda_5*f(x).$$

Wherein, $f(x)=ax^3+bx^2+cx+d$, $x=k/255\in[0,1]$, a, b, c, and d are fitting coefficients of f(x), and $\lambda_1$, $\lambda_2$, $\lambda_3$, $\lambda_4$, and $\lambda_5$ are weight distribution coefficients.

The step of calculating a weighted sum of grayscale values of the base-color sub-pixels of the current original pixel and the adjacent original pixels by the weighted factors to obtain the grayscale values of the base-color sub-pixels of the current sub-pixel of the current sampled pixel further includes the following steps.

Obtaining the grayscale values of the base-color sub-pixels of the current sub-pixel of the current sampled pixel by the equation listed below.

$$h_o=w_1*h_{i-2}+w_2*h_{i-1}+w_3*h_i+w_4*h_{i+1}+w_5*h_{i+2}.$$

Wherein $h_o$ relates to the grayscale value of the base-color sub-pixel of the current sub-pixel of the current sampled pixel, $h_i$ relates to the grayscale value of the base-color sub-pixel of the current original pixel, $h_{i-2}$ and $h_{i-1}$ relates to the grayscale values of the base-color sub-pixels of the two previous original pixels adjacent to the current original pixel, and $h_{i+1}$ and $h_{i+2}$ relates to the grayscale values of the base-color sub-pixels of the two next original pixels adjacent to the current original pixel.

In another aspect, a display device includes: a grayscale obtaining unit obtaining grayscale values of sub-pixels of a current original pixel and adjacent original pixels of the original image; a grayscale degree calculation unit calculating a grayscale degree of the base-color sub-pixel of the sub-pixels of the current original pixel and selecting a maximum grayscale degree from a plurality of grayscale degrees; a weight determination unit determining weighted factors corresponding to current sampled pixels of a sampled image in accordance with the maximum grayscale degree; a summing unit calculating the weighted sum of grayscale values of the base-color sub-pixels of the current original pixel and the adjacent original pixels by the weighted factors to obtain the grayscale value of the base-color sub-pixel of the current sub-pixel of the current sampled pixel; and a filling unit respectively filling the grayscale values of the base-color sub-pixels of the current sub-pixels of the current sampled pixels into the base-color sub-pixels of the current sampled pixels.

Wherein the device further includes: a determination unit determines whether the current original pixel is the base-color sub-pixel in accordance with the grayscale values of each of the base-color sub-pixels of the current original pixel, the grayscale degree calculation unit calculates the grayscale degree of the base-color sub-pixel of the sub-pixels of the current original pixel when the current original pixel is not the pure-color pixel; and a control unit fills the grayscale values of the sub-pixel having the grayscale value larger than zero into the corresponding sub-pixel of the current sampled pixel or the previous sampled pixel in accordance with the locations of the sub-pixels having the grayscale value larger than zero and the location of the current sub-pixel of the current sampled pixel.

Wherein the current original pixel and the current sampled pixel respectively includes a first sub-pixel, a second sub-pixel, a third sub-pixel and a fourth sub-pixel arranged in sequence, the control unit is configured for: when the sub-pixel having the grayscale value larger than zero is the first sub-pixel or the second sub-pixel of the current original pixel and the current sub-pixel is the first sub-pixel or the second sub-pixel of the current sampled pixel, the grayscale values of the first sub-pixel and the second sub-pixel of the current original pixel are fed into the first sub-pixel and the second sub-pixel of the current sampled pixel; when the sub-pixel having the grayscale value larger than zero is the first sub-pixel or the second sub-pixel of the current original pixel and the current sub-pixel is the third sub-pixel or the fourth sub-pixel of the current sampled pixel, the grayscale values of the first sub-pixel and the second sub-pixel of the current original pixel are fed into the first sub-pixel and the second sub-pixel of the current sampled pixel; when the sub-pixel having the grayscale value larger than zero is the third sub-pixel or the fourth sub-pixel of the current original pixel and the current sub-pixel is the third sub-pixel or the fourth sub-pixel of the current sampled pixel, the grayscale values of the third sub-pixel and the fourth sub-pixel of the current original pixel are filled into the third sub-pixel and the fourth sub-pixel of the current sampled pixel; and when the sub-pixel having the grayscale value larger than zero is the third sub-pixel or the fourth sub-pixel of the current original pixel and the current sub-pixel is the first sub-pixel or the second sub-pixel of the current sampled pixel, the grayscale values of the third sub-pixel and the fourth sub-pixel of the current original pixel are filled into the third sub-pixel and the fourth sub-pixel of the previous sampled pixel.

In view of the above, the grayscale degree of the base-color sub-pixel of the current original pixel is calculated, and the weighted factors of the current sampled pixel is constructed in accordance with the grayscale degree. The weighted sum with respect to the base-color sub-pixels of the current original pixel and the adjacent original pixel are calculated by the weighted factors so as to obtain the grayscale value of the base-color sub-pixel of the current sampled pixel. The grayscale values of the base-color sub-pixel of the current sub-pixel of the current sampled pixel are respectively filled into the base-color sub-pixel of the current sampled pixel. The grayscale values of the current sampled pixel may be obtained by the weighted sum. As such, the overlapped color issue may be eliminated so as to obtain a clear image.

DETAILED DESCRIPTION OF THE EMBODIMENTS

Embodiments of the invention will now be described more fully hereinafter with reference to the accompanying drawings, in which embodiments of the invention are shown.

Figure 1:
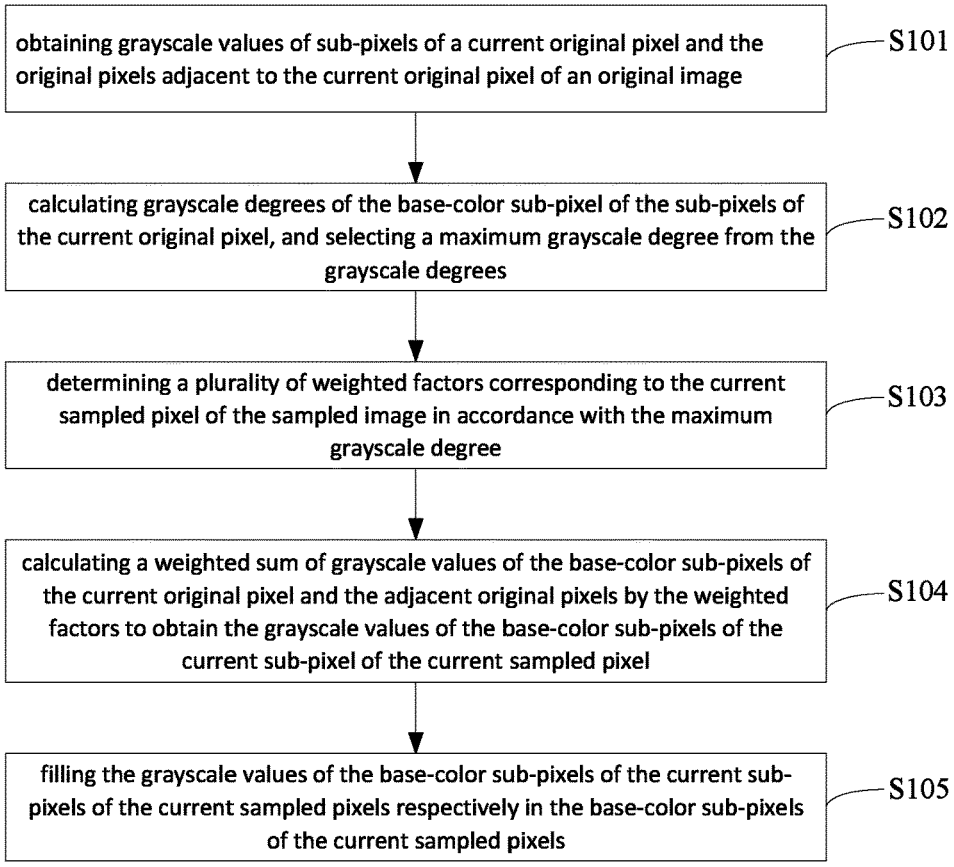
FIG. 1 is a flowchart of the displaying method of the display device in accordance with one embodiment.

FIG. 1 is a flowchart of the displaying method of the display device in accordance with one embodiment. The method calculates the sampled pixels of the sampled image in sequence and then converts the original image having a pixel matrix M*N into a sampled image having the pixel matrix P*Q, wherein M, N, P, Q are natural numbers, and P≤M, Q≤N. In this way, the display device having low resolution is capable of displaying the original image having high resolution. The method includes the following steps.

In block S101, obtaining the grayscale values of the sub-pixels of the original pixel and the adjacent pixels.

Figure 2:
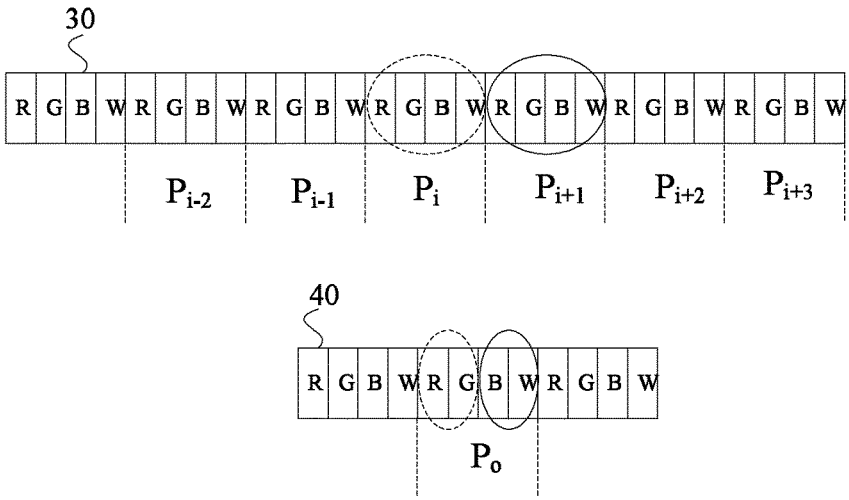
FIG. 2 is a schematic view of the pixel structure of the original image and the sampled image in accordance with one embodiment.

FIG. 2 is a schematic view of one pixel row of the original image 30 and the sampled image 40 in accordance with one embodiment. In the embodiment, the resolution of the sampled image 40 is P*Q. The resolution of the display device is the same with resolution of the sampled image 40, and the resolution of the original image 30 is M*N, wherein M=2P, N and Q are the same. That is, the horizontal resolution of the original image 30 is one times that of the sampled image 40. The vertical resolution of the original image 30 is the same with that of the sampled image 40. The sampled pixels of the sampled image 40 are the pixels of the original image 30 having M*N pixels after the sampling process.

The original pixel and the sampled pixel respectively includes a first sub-pixel (R), a second sub-pixel (G), a third sub-pixel (B) and a fourth sub-pixel (W) arranged in sequence. The first sub-pixel (R), the second sub-pixel (G), the third sub-pixel (B) and the fourth sub-pixel (W) are respectively red sub-pixel, green sub-pixel, blue sub-pixel, and white sub-pixel.

The original image 30 is converted from an input image having a pixel matrix (M*N). The input pixels of the input image includes the red sub-pixel, the green sub-pixel, and the blue sub-pixel arranged in sequence. The input pixels correspond to the original pixels one by one.

In the embodiment, the grayscale values of the first sub-pixel (R), the second sub-pixel (G), the third sub-pixel (B), the fourth sub-pixel (W) of the original pixel ($P_i$) and the adjacent pixel ($P_{i-1}$), ($P_{i-1}$).

In block S102, the grayscale degree of the base-color sub-pixel of the sub-pixels of the current original pixel is calculated, and a maximum grayscale degree is selected from the grayscale degrees, wherein the first sub-pixel (R), the second sub-pixel (G), the third sub-pixel (B) are base-color sub-pixels, and the fourth sub-pixel (W) is not the base-color sub-pixels. The grayscale degrees of the base-color sub-pixels of the current original pixel ($P_i$) is calculated by the following equation.

$$GL_{R_max}=\max\{|R_{i-1}-R_i|,|R_i-R_{i+1}|\} \quad (1).$$

$$GL_{G_max}=\max\{|G_{i-1}-G_i|,|G_i-G_{i+1}|\} \quad (2).$$

$$GL_{B_max}=\max\{|B_{i-1}-B_i|,|B_i-B_{i+1}|\} \quad (3).$$

$$GL_{C_max}=\max\{GL_{R_max},GL_{G_max},GL_{B_max}\} \quad (4).$$

Wherein equations (1), (2) and (3) are respectively for calculating the grayscale degrees of the first sub-pixel (R), the second sub-pixel (G), and the third sub-pixel (B) of the current original pixel ($P_i$). The $R_i$, $G_i$, and $B_i$ respectively relates to the grayscale values of the first sub-pixel (R), the second sub-pixel (G), the third sub-pixel (B) of the current original pixel ($P_i$).

The $R_{i-1}$, $G_{i-1}$, and $B_{i-1}$ respectively relates to the grayscale values of the first sub-pixel (R), the second sub-pixel (G), the third sub-pixel (B) of the previous original pixel ($P_i$) adjacent to the current original pixel ($P_i$). The $R_{i+1}$, $G_{i+1}$, and $B_{i+1}$ respectively relates to the grayscale values of the first sub-pixel (R), the second sub-pixel (G), the third sub-pixel (B) of the next original pixel ($P_i$) adjacent to the current original pixel ($P_i$).

The $GL_{R_max}$, $GL_{G_max}$, $GL_{B_max}$ respectively relates to the maximum and absolute difference between the respective first sub-pixel (R), the second sub-pixel (G), and the third sub-pixel (B) of the original pixel ($P_i$) and that of the corresponding previous original pixel ($P_{i-1}$) and the next original pixel ($P_i$). The $GL_{C_max}$ relates to the maximum grayscale degree among the grayscale degrees of the first sub-pixel (R), the second sub-pixel (G), and the third sub-pixel (B) of the current original pixel ($P_i$). That is, the maximum grayscale degree among the $GL_{R_max}$, $GL_{G_max}$, and $GL_{B_max}$.

Figure 3:
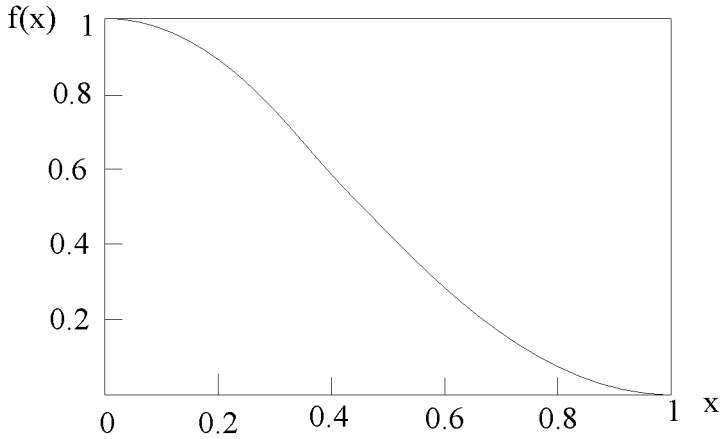
FIG. 3 is a curve diagram showing the three polynomial functions in accordance with one embodiment.

In block S103, a plurality of weighted factors corresponding to the current sampled pixel of the sampled image is determined in accordance with the maximum grayscale degree, wherein the parameter $k=GL_{C_max}\in[0,255]$, and [0,255] represents that there are totally 256 grayscale degrees. The weighted factors corresponding to the current sampled pixel ($P_o$) by the three polynomial function as listed below.

$$f(x)=ax^3+bx^2+cx+d \quad (5).$$

Wherein $x=k/255\in[0,1]$, a, b, c and d are fitting coefficients of the three polynomial function f(x), and may be configured in accordance with real scenarios. The curve of the three polynomial function f(x) is shown in FIG. 3. The weighted factors of the corresponding current sampled pixel ($P_o$) are shown as listed below:

$$w_1=\lambda_1*f(x) \quad (6).$$

$$w_2=\lambda_2*f(x) \quad (7).$$

$$w_3=\lambda_3*f(x) \quad (8).$$

$$w_4=\lambda_4*f(x) \quad (8).$$

$$w_5=\lambda_5*f(x) \quad (10).$$

Wherein $w_1$, $w_2$, $w_3$, $w_4$, $w_5$ are five weighted factors corresponding to the current sampled pixel ($P_o$), $\lambda_1$, $\lambda_2$, $\lambda_3$, $\lambda_4$, $\lambda_5$ are weight distribution coefficients that can be determined in accordance with real scenarios and are of Gaussian Distribution. That is, the relationship between the $\lambda_1$, $\lambda_2$, $\lambda_3$, $\lambda_4$, $\lambda_5$ is: $\lambda_1=\lambda_5<\lambda_2=\lambda_4<\lambda_3$. In this way, the central sub-pixel owns a higher weight ratio.

In block S104, a weighted sum of grayscale values of the base-color sub-pixels of the current original pixel and the adjacent original pixels is calculated by the weighted factors to obtain the grayscale value of the base-color sub-pixels of the current sub-pixel of the current sampled pixel.

Specifically, the grayscale value of the base-color sub-pixel of the current sub-pixel of the current sampled pixel ($P_o$) may be calculated by the equation below.

$$h_o=w_1*h_{i-2}+w_2*h_{i-1}+w_3*h_i+w_4*h_{i+1}+w_5*h_{i+2} \quad (11).$$

Wherein $h_o$ relates to the grayscale value of the base-color sub-pixel of the current sub-pixel of the current sampled pixel ($P_o$), $h_i$ relates to the grayscale value of the base-color sub-pixel of the current original pixel ($P_i$), $h_{i-2}$ and $h_{i-1}$ relates to the grayscale values of the base-color sub-pixels of the two previous original pixels ($P_{i-2}$, $P_{i-1}$) adjacent to the current original pixel ($P_i$) $h_{i+1}$ and $h_{i-2}$ relates to the grayscale values of the base-color sub-pixels of the two next original pixels ($P_{i+1}$,$P_{i+2}$) adjacent to the current original pixel ($P_i$). That is, the weighted sum is calculated by the grayscale values of the base-color sub-pixels of the current original pixel ($P_i$), two previous original pixels ($P_{i-2}$, $P_{i-1}$) adjacent to the current original pixel ($P_i$) and two next original pixels ($P_{i+1}$, $P_{i+2}$) adjacent to the current original pixel ($P_i$) so as to obtain the grayscale value of the base-color sub-pixel of the current sub-pixel of the current sampled pixel ($P_o$).

For instance, when the base-color sub-pixel of the current sub-pixel of the current sampled pixel ($P_o$) is the first sub-pixel (R), the grayscale value ($R_o$) of the first sub-pixel (R) of the current sub-pixel of the current sampled pixel ($P_o$) may be calculated by equation (11) as below.

$$R_o=w_1*R_{i-2}+w_2*R_{i-1}+w_3*R_i+w_4*R_{i+1}+w_5*R_{i+2}.$$

Wherein $R_i$ relates to the grayscale value of the first sub-pixel (R) of the current original pixel ($P_i$) $R_{i-2}$, $R_{i-1}$ respectively relates to the grayscale values of the first sub-pixel (R) of the two previous original pixels ($P_{i-2}$, $P_{i-1}$) adjacent to the current original pixel ($P_i$), $R_{i+1}$, $R_{i+2}$ respectively relates to the grayscale values of the first sub-pixel (R) of the two next original pixels ($P_{i+1}$, $P_{i+2}$) adjacent to the current original pixel ($P_i$). When the base-color sub-pixel of the current sub-pixel of the current sampled pixel ($P_o$) is the second sub-pixel (G) or the third sub-pixel (B), the grayscale value of the second sub-pixel (G) and the third sub-pixel (B) of the current sampled pixel ($P_o$) may be obtained by equation (11) above.

It can be understood that, in other embodiments, the weighted factors may be two, three, seven or other numbers. That is, more or better adjacent original pixels may be adopted to calculate the weighted sum so as to obtain the grayscale value of the sub-pixel of the sampled pixel.

In block S105, the grayscale values of the base-color sub-pixels of the current sub-pixel of the current sampled pixels are respectively filled in the base-color sub-pixels of the current sampled pixels. In this way, the base-color sub-pixel of the current sampled pixels are displayed.

The grayscale values of the base-color sub-pixels of the sampled pixels of the remaining sampled image may be obtained by steps S101-S105.

In this embodiment, after block S101, the maximum grayscale value of the fourth sub-pixel of the current original pixel and the adjacent pixels are selected to obtain the grayscale value of the fourth sub-pixel (W) of the current sampled pixel. The grayscale value of the fourth sub-pixel of the current sampled pixel is filled into the fourth sub-pixel of the current sampled pixel.

Specifically, when the current sub-pixel of the current sampled pixel ($P_o$) is the fourth sub-pixel (W), the grayscale value of the fourth sub-pixel (W) of the current sub-pixel of the current sampled pixel ($P_o$) may be obtained by the equation below.

$$W_o=\max\{W_{i-1},W_i,W_{i+1}\} \quad (12).$$

Wherein $W_o$ relates to the grayscale value of the fourth sub-pixel (W) of the current sub-pixel of the current sampled pixel ($P_o$), $W_i$ relates to the grayscale value of the fourth sub-pixel (W) of the original pixel ($P_i$), $W_{i-1}$ relates to the grayscale value of the fourth sub-pixel (W) of the previous original pixel ($P_{i-1}$) adjacent to the original pixel ($P_i$), $W_{i+1}$ relates to the grayscale value of the fourth sub-pixel (W) of the next original pixel ($P_{i+1}$) adjacent to the original pixel ($P_i$), $W_o$ is the maximum one among $W_i$, $W_{i-1}$, and $W_{i+1}$.

In this way, the grayscale value of the fourth sub-pixel of the current sampled pixel may be obtained. In this embodiment, the grayscale degree of the base-color sub-pixel of the current original pixel is calculated, and the weighted factors of the current sampled pixel is constructed in accordance with the grayscale degree. The weighted sum with respect to the base-color sub-pixels of the current original pixel and the adjacent original pixel are calculated by the weighted factors so as to obtain the grayscale value of the base-color sub-pixel of the current sampled pixel. That is, the resolution is enhanced by the pixels in the rim. Compared with the conventional technology, the overlapped color issue may be eliminated so as to obtain a clear image.

In addition, one sampled pixel includes two sets of sub-pixels having a RG sub-pixel set and a BW sub-pixel set. The RG sub-pixel set includes the first sub-pixel (R) and the second sub-pixel (G). The BW sub-pixel set includes the third sub-pixel (B) and the fourth sub-pixel (W). Each of the original pixels corresponds to one set of sub-pixels of one sampled pixel. That is, each of the sampled pixels corresponds to two original pixels. For instance, as shown in FIG. 2, the RG sub-pixel set circled by the dashed ellipse corresponds to the RGBW sub-pixel set circled by the dashed ellipse, and the BW sub-pixel set circled by the ellipse in solid line corresponds to the RGBW sub-pixel set circled by the ellipse in the solid line.

Thus, the current sampled pixel ($P_o$) includes two sub-pixel sets having the RG sub-pixel set and the BW sub-pixel set. When the current sub-pixel of the current sampled pixel ($P_o$) is the first sub-pixel (R) or the second sub-pixel (G), the current original pixel ($P_1$) corresponds to the RG sub-pixel set of the current sampled pixel ($P_o$). When the current sub-pixel of the current sampled pixel ($P_o$) is the first sub-pixel (R) or the second sub-pixel (G), the BW sub-pixel set of the current sampled pixel ($P_o$) corresponds to the next original pixel ($P_{i+1}$).

At this moment, the grayscale value of the first sub-pixel (R) and the second sub-pixel (G) of the current sampled pixel ($P_o$) may be obtained in accordance with the current original pixel ($P_i$). Specifically, the grayscale value ($R_o$, $G_o$) of the first sub-pixel (R) and the second sub-pixel (G) of the current sampled pixel ($P_o$) may be calculated by equation (11).

$$R_o=w_1*R_{i-2}+w_2*R_{i-1}+w_3*R_i+w_4*R_{i+1}+w_5*R_{i+2}.$$

$$G_o=w_1*G_{i-2}+w_2*G_{i-1}+w_3*G_i+w_4*G_{i+1}+w_5*G_{i+2}.$$

When the grayscale values of the base-color sub-pixel of the BW sub-pixel set of the current sampled pixel ($P_o$) is calculated in accordance with the original pixel ($P_{i+1}$) corresponding to the BW sub-pixel set. That is, the current sub-pixel is the third sub-pixel (B) of the current sampled pixel ($P_o$), and the current original pixel is the original pixel ($P_{i+1}$). Thus, the grayscale value ($B_o$) of the third sub-pixel (B) of the current sampled pixel ($P_o$) may be calculated by equation (11).

$$B_o=w_1*B_{i-1}+w_2*B_i+w_3*B_{i+1}+w_4*B_{i+2}+w_5*B_{i+3}.$$

Wherein $B_{i+1}$ is adopted as the grayscale value of the third sub-pixel (B) of the original pixel ($P_{i+1}$) of the current original pixel.

When the fourth sub-pixel (W) of the BW sub-pixel set of the current sampled pixel ($P_o$) is calculated, the current sub-pixel is the third sub-pixel (B) of the current sampled pixel ($P_o$), and the current original pixel is the original pixel ($P_{i+1}$). The grayscale value ($W_o$) of the fourth sub-pixel (W) of the current sampled pixel ($P_o$) may be calculated by equation (12).

$$W_o=\max\{W_i, W_{i+1}, W_{i+2}\}.$$

Wherein $W_{i+1}$ is adopted as the grayscale value of the fourth sub-pixel (W) of the original pixel ($P_{i+1}$) of the current original pixel.

Thus, in the embodiment, when the sub-pixels of the RG sub-pixel set of the current sub-pixel of the current sampled pixel is calculated, the current original pixel is the original pixel corresponding to the RG sub-pixel set. When the sub-pixels of the BW sub-pixel set of the current sub-pixel of the current sampled pixel is calculated, the current original pixel is the original pixel corresponding to the BW sub-pixel set. Thus, the grayscale values of the base-color sub-pixels of the sampled pixels may be obtained by steps S101-S105, and the grayscale values of the non-base-color sub-pixel of the sampled pixel may be obtained by equation (12). The RG sub-pixel set and the BW sub-pixel set of the current sampled pixel respectively corresponds to different original pixels.

The grayscale values of the remaining sampled pixels may be obtained in view of the above disclosure.

In the embodiment, each of the sampled pixels includes two sub-pixel sets. Each of the original pixels corresponds to one sub-pixel set of one sampled pixel. That is, each of the sampled pixel corresponds to two sets of the original pixels. Thus, the horizontal resolution of the original image is one times that of the sampled image. The vertical resolution of the original is the same with that of the sampled image. Thus, one sub-pixel set of the sampled pixel is viewed as one virtual sampled pixel. The resolution of the virtual sampled image constructed by the virtual sampled pixels is the same with the resolution of the original image. Thus, when the virtual sampled image is displayed on the display device, the resolution is the same with that of the original image. Thus, the displayed image has a high resolution, and thus the resolution of the image is enhanced.

It can be understood that one sampled pixel may include four sub-pixel sets. Each of the sub-pixel set include one sub-pixel, and each of the sub-pixel sets corresponds to one original pixel. The grayscale value of each of the sub-pixel sets of the sampled pixel is calculated in accordance with the grayscale value of the corresponding original pixel.

Figure 4:
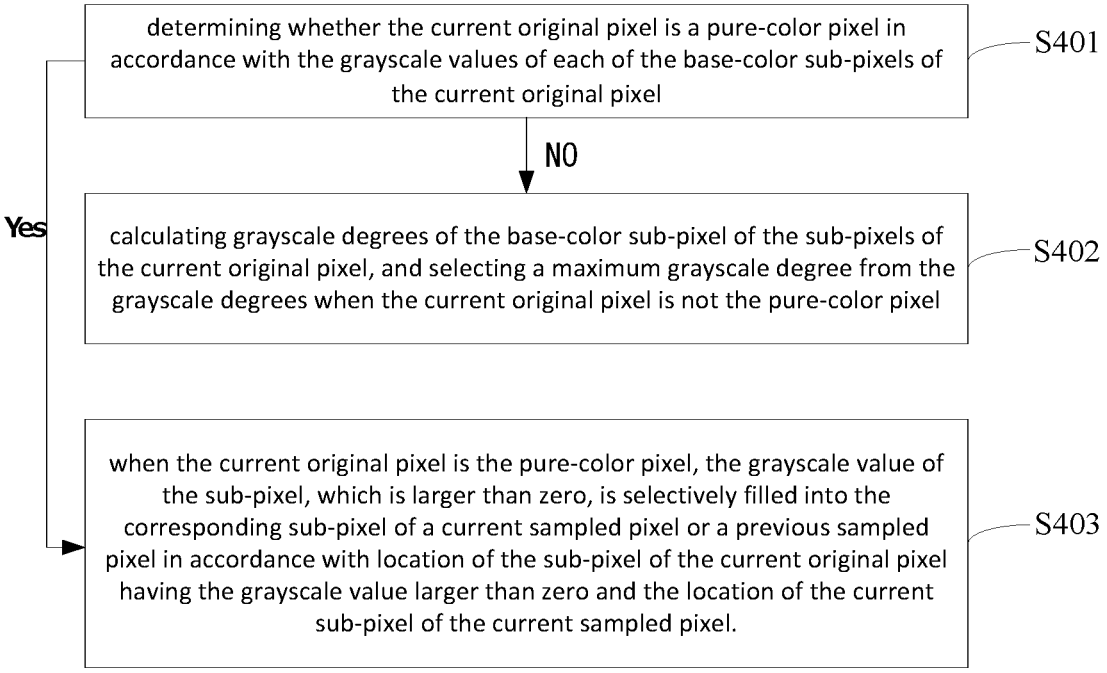
FIG. 4 is a flowchart illustrating the steps after obtaining the grayscale values of the sub-pixels of the original pixel and the adjacent pixels in accordance with one embodiment.

In order to keep the information within the original image, in the embodiment as shown in FIG. 4, after the step of obtaining the grayscale values of the sub-pixels of the original pixel and the adjacent pixels, the method further includes the following steps.

In block S401, determining whether the current original pixel is a pure-color pixel in accordance with the grayscale values of each of the base-color sub-pixels of the current original pixel.

Also referring to FIG. 2, a determination is made regarding whether the original pixel ($P_i$) is the pure-color pixel in accordance with the grayscale values of the first sub-pixel (R), the second sub-pixel (G), and the third sub-pixel (B) of the original pixel ($P_i$). When two of the grayscale values of the first sub-pixel (R), the second sub-pixel (G), the third sub-pixel (B) of the original pixel ($P_i$) equal to zero, the original pixel ($P_i$) is determined as the pure-color pixel. Otherwise, the original pixel ($P_i$) is not the pure-color pixel.

In block S402, if the original pixel ($P_i$) is not the pure-color pixel, the grayscale degrees of the base-color sub-pixels of the sub-pixels of the current original pixel are calculated.

When the original pixel ($P_i$) is not the pure-color pixel, the process goes to the block S102, and S103-S105. In this way, the grayscale values of the base-color sub-pixel of the current sub-pixel of the current sampled pixel are obtained.

In block S403, when the original pixel ($P_i$) is the pure-color pixel, the grayscale value of the sub-pixel, which is larger than zero, is selectively filled into the corresponding sub-pixel of the current sampled pixel or the previous sampled pixel in accordance with the locations of the sub-pixels having the grayscale value larger than zero and the location of the current sub-pixel of the current sampled pixel.

Specifically, when the original pixel ($P_i$) is the pure-color pixel, there are four conditions.

With respect to the first condition, when the sub-pixel of the original pixel ($P_i$) having the grayscale value larger than zero is the first sub-pixel (R) or the second sub-pixel (G) and when the current sub-pixel is the first sub-pixel (R) or the second sub-pixel (G) of the current sampled pixel ($P_o$), the original pixel ($P_i$) is the original pixel corresponding to the RG sub-pixel set of the current sampled pixel ($P_o$). As such, the grayscale values of the first sub-pixel (R) and the second sub-pixel (G) of the original pixel ($P_1$) are filled to the first sub-pixel (R) and the second sub-pixel (G) of the current sampled pixel ($P_o$).

For instance, when the grayscale value of the first sub-pixel (R) of the original pixel ($P_i$) is larger than zero and the grayscale values of the second sub-pixel (G) and the third sub-pixel (B) are zero, the original pixel ($P_i$) is shown as red. In addition, the current sub-pixel of the current sampled pixel ($P_o$) is the first sub-pixel (R) or the second sub-pixel (G) of the RG sub-pixel set. Thus, the RG sub-pixel set of the current sampled pixel ($P_o$) includes the sub-pixel capable of displaying the red of the current original pixel ($P_i$), i.e., the first sub-pixel (R). The grayscale values of the first sub-pixel (R) and the second sub-pixel (G) of the current original pixel ($P_i$) are filled into the first sub-pixel (R) and the second sub-pixel (G) of the current sampled pixel ($P_o$) so as to obtain the grayscale value of the current sub-pixels of the current sampled pixel ($P_o$).

With respect to the second condition, when the sub-pixel of the original pixel ($P_i$) having the grayscale value larger than zero is the first sub-pixel (R) or the second sub-pixel (G) and when the current sub-pixel is the third sub-pixel (B) or the fourth sub-pixel (W) of the current sampled pixel ($P_o$), the original pixel ($P_i$) is the original pixel corresponding to the BW sub-pixel set of the current sampled pixel ($P_o$). As such, the grayscale values of the first sub-pixel (R) and the second sub-pixel (G) of the original pixel ($P_1$) are filled to the first sub-pixel (R) and the second sub-pixel (G) of the current sampled pixel ($P_o$).

For instance, when the grayscale value of the first sub-pixel (R) of the original pixel ($P_i$) is larger than zero and the grayscale values of the first sub-pixel (R) and the third sub-pixel (B) are zero, the original pixel ($P_i$) is still shown as red. The current sub-pixel of the current sampled pixel ($P_o$) is the third sub-pixel (B) or the fourth sub-pixel (W) of the BW sub-pixel set. Thus, the BW sub-pixel set of the current sampled pixel ($P_o$) does not include the sub-pixel capable of displaying the red of the current original pixel ($P_i$).

The grayscale values of the first sub-pixel (R) and the second sub-pixel (G) of the current original pixel ($P_i$) are filled into the first sub-pixel (R) and the second sub-pixel (G) of the current sampled pixel ($P_o$), that is, the energy is leftward shifted. Under the circumstance, the first sub-pixel (R) and the second sub-pixel (G) of the RG sub-pixel set of the current sampled pixel ($P_o$) have the grayscale value by themselves, and the grayscale values are overlapped with the filled grayscale values of the first sub-pixel (R) and the second sub-pixel (G) of the original pixel ($P_i$).

In other words, when the color displayed by the current original pixel is different from that of the corresponding sub-pixels within the sub-pixel set of the current sampled pixel, the energy is leftward shifted. That is, the grayscale value of the current original pixel is filled into the sub-pixel of the adjacent and previous sub-pixel set.

With respect to the third condition, when the sub-pixel of the original pixel ($P_i$) having the grayscale value larger than zero is the third sub-pixel (B) or the fourth sub-pixel (W) and when the current sub-pixel is the third sub-pixel (B) or the fourth sub-pixel (W) of the current sampled pixel ($P_o$), the original pixel ($P_i$) is the original pixel corresponding to the BW sub-pixel set of the current sampled pixel ($P_o$). As such, the grayscale values of the third sub-pixel (B) and the fourth sub-pixel (W) of the current original pixel are fed to the third sub-pixel (B) and the fourth sub-pixel (W) of the current sampled pixel ($P_o$).

For instance, when the grayscale value of the third sub-pixel (B) of the original pixel ($P_i$) is larger than zero and the grayscale values of the first sub-pixel (R) and the second sub-pixel (G) are zero, the original pixel ($P_i$) is shown as green. The current sub-pixel of the current sampled pixel ($P_o$) is the third sub-pixel (B) or the fourth sub-pixel (W) of the BW sub-pixel set. The BW sub-pixel set of the current sampled pixel ($P_o$) includes the sub-pixel capable of displaying the green of the current original pixel ($P_i$). Thus, the grayscale values of the third sub-pixel (B) and the fourth sub-pixel (W) of the original pixel ($P_i$) are filled into the third sub-pixel (B) and the fourth sub-pixel (W) of the current sampled pixel ($P_o$).

With respect to the fourth condition, when the sub-pixel of the original pixel ($P_i$) having the grayscale value larger than zero is the third sub-pixel (B) or the fourth sub-pixel (W) and when the current sub-pixel is the first sub-pixel (R) or the second sub-pixel (G) of the current sampled pixel ($P_o$), the grayscale values of the third sub-pixel (B) and the fourth sub-pixel (W) of the current original pixel are fed into the third sub-pixel (B) and the fourth sub-pixel (W) of the previous sampled pixel adjacent to the current sampled pixel ($P_o$).

For instance, when the grayscale value of the third sub-pixel (B) of the original pixel ($P_i$) is larger than zero and the grayscale values of the first sub-pixel (R) and the third sub-pixel (B) are zero, the original pixel ($P_i$) is still shown as green. The current sub-pixel of the current sampled pixel ($P_o$) is the first sub-pixel (R) or the second sub-pixel (G) of the RG sub-pixel set.

The RG sub-pixel set of the current sampled pixel ($P_o$) does not include the sub-pixel capable of displaying the green of the current original pixel ($P_i$). Thus, the grayscale values of the third sub-pixel (B) and the fourth sub-pixel (W) of the original pixel ($P_i$) are filled into the third sub-pixel (B) and the fourth sub-pixel (W) of the current sampled pixel ($P_o$). Under the circumstance, the third sub-pixel (B) and the fourth sub-pixel (W) of the previous sampled pixel have the grayscale value by themselves, and the grayscale values are overlapped with the filled grayscale values of the third sub-pixel (B) and the fourth sub-pixel (W) of the original pixel ($P_i$).

In this way, when the current original pixel is the pure-color pixel, if the displayed color of the current original pixel is different from that of the two sub-pixels within the same sub-pixel set of the current sampled pixel, the grayscale value of the sub-pixel of the current original pixel is filled into the previous sub-pixel set of the current sampled pixel, i.e., the energy is leftward shifted. As such, the portion having a higher brightness of the original image may be kept, and the energy may be shifted unitarily. This may effectively eliminate overlapped color issue so as to obtain a clear image.

In other embodiments, the energy may be rightward shifted. That is, the grayscale values of the sub-pixels of the current original pixel may be filled into the next sub-pixel set of the current sampled pixel.

The embodiments will be described in accordance with the sampled image having the resolution of 5*Q, wherein P=5 represents five sampled pixels are contained within one pixel row of the sampled image. The resolution of the display device is the same with the resolution of the sampled image.

Figure 5:
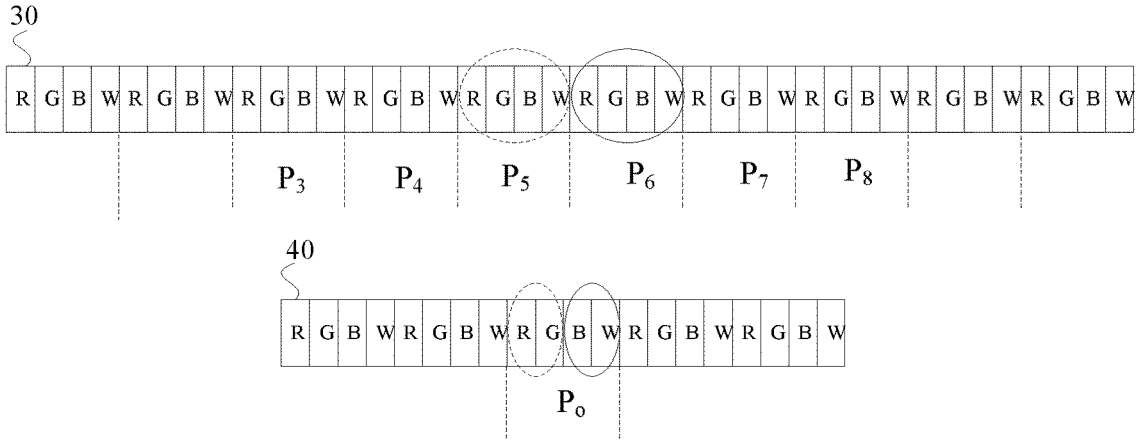
FIG. 5 is a schematic view of one pixel row of the original image and the sampled image in accordance with one embodiment.

FIG. 5 is a schematic view of one pixel row of the original image 30 and the sampled image 40 in accordance with one embodiment. In the embodiment, the resolution of the original image 30 is 10*N, i.e., M=10 represents 10 original pixels are contained in one pixel row, and wherein Q and N are equal. That is, the horizontal resolution of the original image 30 is one times that of the sampled image. The vertical resolution of the original image is the same as that of the sampled image.

When the current original pixel is $P_5$, the current sampled pixel is $P_o$, and the current sub-pixel of the current sampled pixel ($P_o$) is the sub-pixel within the RG sub-pixel set. The current original pixel $P_5$ corresponds to the RG sub-pixel set of the current sampled pixel ($P_o$), that is, the current sub-pixel is the first sub-pixel (R) or the second sub-pixel (G) of the current sampled pixel ($P_o$). At this moment, the grayscale values of the first sub-pixel (R) and the second sub-pixel (G) of the current sampled pixel ($P_o$) may be obtained in accordance with the original pixel $P_5$.

Specifically, in block S101, the grayscale values of the first sub-pixel (R), the second sub-pixel (G), the third sub-pixel (B), and the fourth sub-pixel (W) of the current original pixel $P_5$ and the adjacent original pixel $P_3$, $P_4$, $P_6$, and $P_7$ are obtained. Afterward, the determination regarding whether the current original pixel $P_5$ is the pure-color pixel is made in accordance with the grayscale values of the first sub-pixel (R), the second sub-pixel (G), and the third sub-pixel (B) of the $P_5$.

When the current original pixel $P_5$ is the pure-color pixel, the grayscale values of the two base-color sub-pixels are zero at the same time. If the grayscale value of the sub-pixel of the current original pixel $P_5$ larger than zero is the first sub-pixel (R) or the second sub-pixel (G), the current sub-pixel of the current sampled pixel ($P_o$) is the sub-pixel within the RG sub-pixel set. Under the first condition, the grayscale values of the first sub-pixel (R) and the second sub-pixel (G) of the current original pixel $P_5$ are filled into the first sub-pixel (R) and the second sub-pixel (G) of the current sampled pixel ($P_o$). Thus, the grayscale values of the first sub-pixel (R) and the second sub-pixel (G) of the current sampled pixel ($P_o$) are obtained.

If the grayscale value of the sub-pixel of the current original pixel $P_5$ larger than zero is the third sub-pixel (B) or the fourth sub-pixel (W), the sub-pixel of the current sampled pixel ($P_o$) is the sub-pixel within the RG sub-pixel set, which belongs to the fourth condition stated above. At this moment, the grayscale values of the third sub-pixel (B) and the fourth sub-pixel (W) of the current original pixel $P_5$ are filled into the third sub-pixel (B) and the fourth sub-pixel (W) of the previous sampled pixel adjacent to the current sampled pixel ($P_o$) so as to keep more information within the original image.

When the current original pixel $P_5$ is not the pure-color pixel, the process goes to step S102 so as to calculate the grayscale value of the sub-pixel of the current sampled pixel. As stated in the step S102, the grayscale degrees of the first sub-pixel (R), the second sub-pixel (G), and the third sub-pixel (B) of current original pixel $P_5$ are calculated in accordance with equation (1), (2), and (3).

$$GL_{R_max}=\max\{|R_4-R_5|,|R_5-R_6|\}.$$

$$GL_{G_max}=\max\{|G_4-G_5|,|G_5-G_6|\}.$$

$$GL_{B_max}=\max\{|B_4-B_5|,|B_5-B_6|\}.$$

According to equation (4), the maximum grayscale degree is selected from the three grayscale degrees $GL_{R_max}$, $GL_{G_max}$, and $GL_{B_max}$ to obtain the $GL_{C_max}$. Afterward, the five weighted factors $w_1$, $w_2$, $w_3$, $w_4$, and $w_5$ corresponding to the first sub-pixel (R) and the second sub-pixel (G) of the current sampled pixel ($P_o$) are calculated in accordance with equations (5), (6), (7), (8), (9), and (10).

As the current sub-pixel of the current sampled pixel ($P_o$) is the first sub-pixel (R) or the second sub-pixel (G), the grayscale values of the first sub-pixel (R) or the second sub-pixel (G) of the current sampled pixel ($P_o$) may be obtained in step S104.

$$R_o=w_1*R_3+w_2*R_4+w_3*R_5+w_4*R_6+w_5*R_7.$$

$$G_o=w_1*G_3+w_2*G_4+w_3*G_5+w_4*G_6+w_5*G_7.$$

The grayscale value $R_o$ of the first sub-pixel (R) and the grayscale value $G_o$ of the second sub-pixel (G) of the current sampled pixel ($P_o$) are filled into the first sub-pixel (R) and the second sub-pixel (G) of the current sampled pixel ($P_o$).

When calculating the next sub-pixel set of the current sampled pixel ($P_o$), the current sub-pixel of the current sampled pixel ($P_o$) is the sub-pixel within the BW sub-pixel set, and the sub-pixel is the third sub-pixel (B) or the fourth sub-pixel (W) of the current sampled pixel ($P_o$). At this moment, the current sub-pixel of the current sampled pixel ($P_o$) is the next original pixel $P_6$ corresponding to the BW sub-pixel set. The grayscale values of the third sub-pixel (B) and the fourth sub-pixel (W) of the current sampled pixel ($P_o$) are obtained by the original pixel $P_6$. Specifically, the grayscale degrees $GL_{R_max}$, $GL_{G_max}$, and $GL_{B_max}$ of the first sub-pixel (R), the second sub-pixel (G), and the third sub-pixel (B) of the current original pixel $P_6$ may be calculated by equations (1), (2) and (3), and the maximum grayscale degree $GL_{C_max}$ is selected from the three grayscale degrees by equation (4). The five weighted factors $w_1$, $w_2$, $w_3$, $w_4$, and $w_5$ corresponding to the third sub-pixel (B) of the current sampled pixel ($P_o$) may be calculated in accordance with equation (5), (6), (7), (8), (9) and (10).

The current sub-pixel of the current sampled pixel ($P_o$) is the third sub-pixel (B) or the fourth sub-pixel (W), and the third sub-pixel (B) is the base-color sub-pixel. Thus, when the current sub-pixel is the third sub-pixel (B), the grayscale value of the third sub-pixel (B) of the current sampled pixel ($P_o$) is calculated by step S104 as listed below.

$$B_o=w_1*B_4+w_2*B_5+w_3*B_6+w_4*B_7+w_5*B_8.$$

Wherein when the current sub-pixel of the current sampled pixel ($P_o$) is the fourth sub-pixel (W), the grayscale value of the fourth sub-pixel (W) of the current sampled pixel ($P_o$) may be obtained by equation (12).

$$W_o=\max\{W_5,W_6,W_7\}.$$

The grayscale value $W_o$ of the fourth sub-pixel (W) of the current sampled pixel ($P_o$) equals to the maximum grayscale value among the three grayscale values $W_5$, $W_6$, and $W_7$.

The grayscale value $B_o$ of the third sub-pixel (B) of the current sampled pixel ($P_o$) and the grayscale value $W_o$ of the fourth sub-pixel (W) of the current sampled pixel ($P_o$) are respectively filled into the first sub-pixel (R) and the fourth sub-pixel (W) of the current sampled pixel ($P_o$).

Thus, the first sub-pixel (R), the second sub-pixel (G), the third sub-pixel (B), and the fourth sub-pixel (W) of the current sampled pixel ($P_o$) may be displayed.

Figure 6:
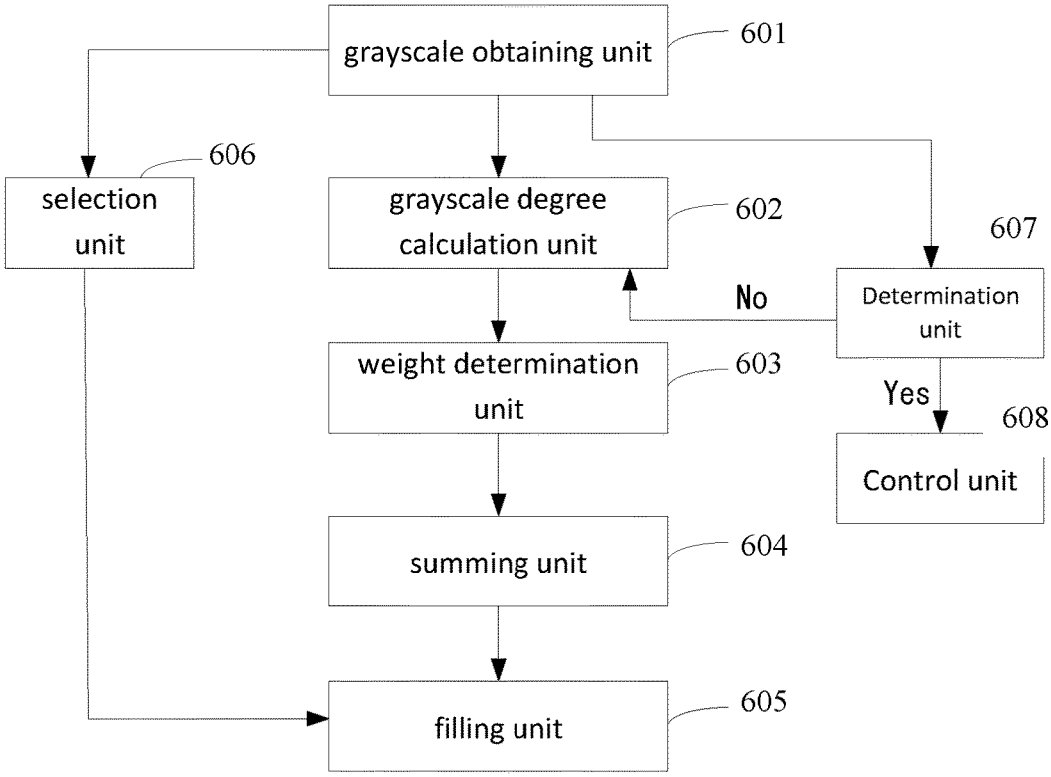
FIG. 6 is a schematic view of the display device in accordance with one embodiment.

FIG. 6 is a schematic view of the display device in accordance with one embodiment. The display device includes a grayscale obtaining unit 601, a grayscale degree calculation unit 602, a weight determination unit 603, a summing unit 604, and a filling unit 605.

The grayscale obtaining unit 601 obtains the grayscale values of the sub-pixels of the current original pixel and the adjacent original pixels of the original image. The weight determination unit 603 determines the weighted factors corresponding to the current sampled pixels of the sampled image in accordance with the maximum grayscale degree. The summing unit 604 calculates the weighted sum of grayscale values of the base-color sub-pixels of the current original pixel and the adjacent original pixels by the weighted factors to obtain the grayscale value of the base-color sub-pixel of the current sub-pixel of the current sampled pixel. The filling unit 605 respectively fills the grayscale values of the base-color sub-pixels of the current sub-pixels of the current sampled pixels into the base-color sub-pixels of the current sampled pixels.

The original pixel and the sampled pixel respectively includes a first sub-pixel (R), a second sub-pixel (G), a third sub-pixel (B) and a fourth sub-pixel (W) arranged in sequence. The first sub-pixel (R), the second sub-pixel (G), the third sub-pixel (B) and the fourth sub-pixel (W) are respectively red sub-pixel, green sub-pixel, blue sub-pixel, and white sub-pixel. In addition, the first sub-pixel (R), the second sub-pixel (G), the third sub-pixel (B) are base-color sub-pixels, and the fourth sub-pixel (W) is not the base-color sub-pixel.

The grayscale values are filled into the corresponding base-color sub-pixels of the current sampled pixels to realize the display of the base-color sub-pixel of the current sampled pixel.

The display device further includes a selection unit 606. When the current sub-pixel of the current sampled pixel is not the base-color sub-pixel, i.e., the fourth sub-pixel (W), the selection unit 606 selects the maximum grayscale value from the fourth sub-pixels of the current original pixel and the adjacent original pixels to obtain the grayscale value of the fourth sub-pixel (W) of the current sampled pixel. In addition, the filling unit 605 fills the grayscale value of the fourth sub-pixel of the current sampled pixel into the fourth sub-pixel of the current sampled pixel.

In this way, the grayscale value of the four sub-pixels of the current sampled pixel may be obtained. In the embodiment, In this way, the grayscale value of the fourth sub-pixel of the current sampled pixel may be obtained. In this embodiment, the grayscale degree of the base-color sub-pixel of the current original pixel is calculated, and the weighted factors of the current sampled pixel is constructed in accordance with the grayscale degree. The weighted sum with respect to the base-color sub-pixels of the current original pixel and the adjacent original pixel are calculated by the weighted factors so as to obtain the grayscale value of the base-color sub-pixel of the current sampled pixel. That is, the resolution is enhanced by the pixels in the rim. Compared with the conventional technology, the overlapped color issue may be eliminated so as to obtain a clear image.

Further, the display device further includes a determination unit 607 and a control unit 608. After the grayscale obtaining unit 601 obtains the grayscale values of the sub-pixels of the current original pixel and the adjacent original pixels of the original image, the determination unit 607 determines whether the current original pixel is the base-color sub-pixel in accordance with the grayscale values of each of the base-color sub-pixels of the current original pixel. The grayscale degree calculation unit 602 calculates the grayscale degree of the base-color sub-pixel of the sub-pixels of the current original pixel when the current original pixel is not the pure-color pixel, and selects the maximum grayscale degree from a plurality of grayscale degrees. Upon determining the current original pixel is the pure-color pixel, the control unit 608 fills the grayscale values of the sub-pixel having the grayscale value larger than zero into the corresponding sub-pixel of the current sampled pixel or the previous sampled pixel in accordance with the locations of the sub-pixels having the grayscale value larger than zero and the location of the current sub-pixel of the current sampled pixel.

The control unit 608 is configured for:

When the sub-pixel having the grayscale value larger than zero is the first sub-pixel or the second sub-pixel of the current original pixel and the current sub-pixel is the first sub-pixel or the second sub-pixel of the current sampled pixel, the grayscale values of the first sub-pixel and the second sub-pixel of the current original pixel are fed into the first sub-pixel and the second sub-pixel of the current sampled pixel.

When the sub-pixel having the grayscale value larger than zero is the first sub-pixel or the second sub-pixel of the current original pixel and the current sub-pixel is the third sub-pixel or the fourth sub-pixel of the current sampled pixel, the grayscale values of the first sub-pixel and the second sub-pixel of the current original pixel are fed into the first sub-pixel and the second sub-pixel of the current sampled pixel.

When the sub-pixel having the grayscale value larger than zero is the third sub-pixel or the fourth sub-pixel of the current original pixel and the current sub-pixel is the third sub-pixel or the fourth sub-pixel of the current sampled pixel, the grayscale values of the third sub-pixel and the fourth sub-pixel of the current original pixel are fed into the third sub-pixel and the fourth sub-pixel of the current sampled pixel.

When the sub-pixel having the grayscale value larger than zero is the third sub-pixel or the fourth sub-pixel of the current original pixel and the current sub-pixel is the first sub-pixel or the second sub-pixel of the current sampled pixel, the grayscale values of the third sub-pixel and the fourth sub-pixel of the current original pixel are fed into the third sub-pixel and the fourth sub-pixel of the previous sampled pixel.

In this way, the overlapped color issue may be eliminated so as to obtain a clear image.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A method of displaying an image on a displaying device, comprising:

obtaining grayscale values of sub-pixels of a current original pixel and original pixels adjacent to the current original pixel of an original image;

determining whether the current original pixel is a pure-color pixel in accordance with the grayscale values of each of the base-color sub-pixels of the current original pixel;

when the current original pixel is a pure-color pixel, the grayscale value of the sub-pixel, which is larger than zero, is set as a grayscale value of a corresponding sub-pixel of a current sampled pixel or a previous sampled pixel in accordance with a location of the sub-pixel of the current original pixel having the grayscale value larger than zero and the location of the current sub-pixel of the current sampled pixel; and when the current original pixel is not a pure-color pixel, the method further comprises:

calculating grayscale degrees of the base-color sub-pixel of the sub-pixels of the current original pixel, and selecting a maximum grayscale degree from the grayscale degrees;

determining a plurality of weighted factors corresponding to the current sampled pixel of the sampled image in accordance with the maximum grayscale degree;

calculating a weighted sum of grayscale values of the base-color sub-pixels of the current original pixel and the adjacent original pixels by the weighted factors to obtain the grayscale values of the base-color sub-pixels of the current sub-pixel of the current sampled pixel;

setting the grayscale values of the base-color sub-pixels of the current sub-pixels of the current sampled pixels respectively as grayscale values of the base-color sub-pixels of the current sampled pixels; wherein the current original pixel and the current sampled pixel respectively comprises a first sub-pixel, a second sub-pixel, a third sub-pixel and a fourth sub-pixel arranged in sequence, the first sub-pixel, the second sub-pixel, and the third sub-pixel are the base-color sub-pixels, and the fourth sub-pixel is not the base-color sub-pixel, after the step of obtaining the grayscale values of sub-pixels of the current original pixel and the original pixels adjacent to the current original pixel of the original image, the method further comprises:

selecting the maximum grayscale value from the grayscale values of the fourth sub-pixels of the current original pixel and the adjacent original pixels to obtain the grayscale value of the fourth sub-pixel of the current sampled pixel; and setting the grayscale value of the fourth sub-pixel of the current sampled pixel as a grayscale value of the fourth sub-pixel of the current sampled pixel.

2. The method as claimed in claim 1, wherein the step of selectively setting the grayscale value of the sub-pixel larger than zero as a grayscale value of the corresponding sub-pixel of the current sampled pixel or the previous sampled pixel further comprises:

when the sub-pixel having the grayscale value larger than zero is the first sub-pixel or the second sub-pixel of the current original pixel and the current sub-pixel is the first sub-pixel or the second sub-pixel of the current sampled pixel, the grayscale values of the first sub-pixel and the second sub-pixel of the current original pixel are respectively set as grayscale values of the first sub-pixel and the second sub-pixel of the current sampled pixel;

when the sub-pixel having the grayscale value larger than zero is the first sub-pixel or the second sub-pixel of the current original pixel and the current sub-pixel is the third sub-pixel or the fourth sub-pixel of the current sampled pixel, the grayscale values of the first sub-pixel and the second sub-pixel of the current original pixel are respectively set as grayscale values of the first sub-pixel and the second sub-pixel of the current sampled pixel;

when the sub-pixel having the grayscale value larger than zero is the third sub-pixel or the fourth sub-pixel of the current original pixel and the current sub-pixel is the third sub-pixel or the fourth sub-pixel of the current sampled pixel, the grayscale values of the third sub-pixel and the fourth sub-pixel of the current original pixel are respectively set as grayscale values of the third sub-pixel and the fourth sub-pixel of the current sampled pixel; and when the sub-pixel having the grayscale value larger than zero is the third sub-pixel or the fourth sub-pixel of the current original pixel and the current sub-pixel is the first sub-pixel or the second sub-pixel of the current sampled pixel, the grayscale values of the third sub-pixel and the fourth sub-pixel of the current original pixel are respectively set as grayscale values of the third sub-pixel and the fourth sub-pixel of the previous sampled pixel.

3. The method as claimed in claim 1, wherein the current sampled pixel comprises at least two sub-pixel sets, the sub-pixel of one of the sub-pixel sets is the current sub-pixel of the current sampled pixel, and the current original pixel corresponds to one sub-pixel set of the current sub-pixel contained by the current sampled pixel.

4. The method as claimed in claim 1, wherein the step of calculating grayscale degrees of the base-color sub-pixel of the sub-pixels of the current original pixel comprises:

calculating the grayscale degrees by the equations:

$$GL_{R_max}=\max\{|R_{i-1}-R_i|,|R_i-R_{i+1}|\}$$

$$GL_{G_max}=\max\{|G_{i-1}-G_i|,|G_i-G_{i+1}|\}$$

$$GL_{B_max}=\max\{|B_{i-1}-B_i|,|B_i-B_{i-1}|\}$$

wherein and $R_i$, $G_i$, $B_i$ respectively relates to the grayscale values of the first sub-pixel, the second sub-pixel, and the third sub-pixel of the current original pixel, $R_{i-1}$, $G_{i-1}$, and $B_{i-1}$ respectively relates to the grayscale values of the first sub-pixel, the second sub-pixel, and the third sub-pixel of the previous original pixel adjacent to the current original pixel, $R_{i+1}$, $G_{i+1}$, and $B_{i+1}$ respectively relates to the grayscale values of the first sub-pixel, the second sub-pixel, and the third sub-pixel of the next original pixel adjacent to the current original pixel, the $GL_{R_max}$, $GL_{G_max}$, $GL_{B_max}$ respectively relates to the grayscale degrees of the first sub-pixel, the second sub-pixel, and the third sub-pixel of the current original pixel;

the step of selecting the maximum grayscale degree from the grayscale degrees further comprises:

selecting the maximum grayscale degrees from the $GL_{R_max}$, $GL_{G_max}$, and $GL_{B_max}$ by the equation:

$$GL_{C_max}=\max\{GL_{R_max},GL_{G_max},GL_{B_max}\}$$

wherein $GL_{C_max}$ relates to the maximum grayscale degree.

5. The method as claimed in claim 4, wherein the step of determining a plurality of weighted factors corresponding to the current sampled pixel of the sampled image in accordance with the maximum grayscale degree further comprises:

defining a parameter $k=GL_{C_max}\in[0,255]$;

calculating five weighted factors $w_1$, $w_2$, $w_3$, $w_4$, $w_5$ corresponding to the current sampled pixel by the equations below:

$$w_1=\lambda_1*f(x)$$

$$w_2=\lambda_2*f(x)$$

$$w_3=\lambda_3*f(x)$$

$$w_4=\lambda_4*f(x)$$

$$w_5=\lambda_5*f(x)$$

wherein $f(x)=ax^3+bx^2+cx+d$, $x=k255\in[0,1]$, a, b, c, and d are fitting coefficients of f(x), and $\lambda_1$, $\lambda_2$, $\lambda_3$, $\lambda_4$, and $\lambda_5$ are weight distribution coefficients;

the step of calculating a weighted sum of grayscale values of the base-color sub-pixels of the current original pixel and the adjacent original pixels by the weighted factors to obtain the grayscale values of the base-color sub-pixels of the current sub-pixel of the current sampled pixel further comprises:

obtaining the grayscale values of the base-color sub-pixels of the current sub-pixel of the current sampled pixel by the equation:

$$h_o=w_1*h_{i-2}+w_2*h_{i-1}+w_3*h_i+w_4*h_{i+1}+w_5*h_{i+2};$$

wherein $h_o$ relates to the grayscale value of the base-color sub-pixel of the current sub-pixel of the current sampled pixel, $h_i$ relates to the grayscale value of the base-color sub-pixel of the current original pixel, $h_{i-2}$ and $h_{i-1}$ relates to the grayscale values of the base-color sub-pixels of the two previous original pixels adjacent to the current original pixel, and $h_{i+1}$ and $h_{i+2}$ relates to the grayscale values of the base-color sub-pixels of the two next original pixels adjacent to the current original pixel.

6. A method of display an original image having an image resolution on a displaying device having a display resolution that is less than the image resolution by converting the original image into sampled pixels of a resolution corresponding to the display resolution, comprising:

obtaining grayscale values of sub-pixels of a current original pixel and the original pixels adjacent to the current original pixel of the original image;

calculating grayscale degrees of base-color sub-pixels of the sub-pixels of the current original pixel, and selecting a maximum grayscale degree from the grayscale degrees;

determining a plurality of weighted factors corresponding to the current sampled pixel of the sampled image in accordance with the maximum grayscale degree;

calculating a weighted sum of grayscale values of the base-color sub-pixels of the current original pixel and the adjacent original pixels by the weighted factors to obtain the grayscale values of the base-color sub-pixels of the current sub-pixel of the current sampled pixel; and setting the grayscale values of the base-color sub-pixels of the current sub-pixels of the current sampled pixels respectively as grayscale values the base-color sub-pixels of the current sampled pixels, wherein the sampled pixels so obtained are displayed on the display device.

7. The method as claimed in claim 6, wherein after the step of obtaining grayscale values of sub-pixels of a current original pixel and the original pixels adjacent to the current original pixel of an original image, the method further comprises:

determining whether the current original pixel is a pure-color pixel in accordance with the grayscale values of each of the base-color sub-pixels of the current original pixel;

calculating grayscale degrees of the base-color sub-pixel of the sub-pixels of the current original pixel, and selecting a maximum grayscale degree from the grayscale degrees when the current original pixel is not the pure-color pixel; and when the current original pixel is the pure-color pixel, the grayscale value of the sub-pixel, which is larger than zero, is selectively set as a grayscale value of the corresponding sub-pixel of a current sampled pixel or a previous sampled pixel in accordance with location of the sub-pixel of the current original pixel having the grayscale value larger than zero and the location of the current sub-pixel of the current sampled pixel.

8. The method as claimed in claim 7, wherein the current original pixel and the current sampled pixel respectively comprises a first sub-pixel, a second sub-pixel, a third sub-pixel and a fourth sub-pixel arranged in sequence, the step of selectively setting the grayscale value of the sub-pixel larger than zero as a grayscale value of the corresponding sub-pixel of the current sampled pixel or the previous sampled pixel further comprises:

when the sub-pixel having the grayscale value larger than zero is the first sub-pixel or the second sub-pixel of the current original pixel and the current sub-pixel is the first sub-pixel or the second sub-pixel of the current sampled pixel, the grayscale values of the first sub-pixel and the second sub-pixel of the current original pixel are respectively set as grayscale values of the first sub-pixel and the second sub-pixel of the current sampled pixel;

when the sub-pixel having the grayscale value larger than zero is the first sub-pixel or the second sub-pixel of the current original pixel and the current sub-pixel is the third sub-pixel or the fourth sub-pixel of the current sampled pixel, the grayscale values of the first sub-pixel and the second sub-pixel of the current original pixel are respectively set as grayscale values of the first sub-pixel and the second sub-pixel of the current sampled pixel;

when the sub-pixel having the grayscale value larger than zero is the third sub-pixel or the fourth sub-pixel of the current original pixel and the current sub-pixel is the third sub-pixel or the fourth sub-pixel of the current sampled pixel, the grayscale values of the third sub-pixel and the fourth sub-pixel of the current original pixel are respectively set as grayscale values of the third sub-pixel and the fourth sub-pixel of the current sampled pixel; and when the sub-pixel having the grayscale value larger than zero is the third sub-pixel or the fourth sub-pixel of the current original pixel and the current sub-pixel is the first sub-pixel or the second sub-pixel of the current sampled pixel, the grayscale values of the third sub-pixel and the fourth sub-pixel of the current original pixel are respectively set as grayscale values of the third sub-pixel and the fourth sub-pixel of the previous sampled pixel.

9. The method as claimed in claim 6, wherein the current original pixel and the current sampled pixel respectively comprises a first sub-pixel, a second sub-pixel, a third sub-pixel and a fourth sub-pixel arranged in sequence, the first sub-pixel, the second sub-pixel, and the third sub-pixel are the base-color sub-pixels, and the fourth sub-pixel is not the base-color sub-pixel, after the step of obtaining the grayscale values of sub-pixels of the current original pixel and the original pixels adjacent to the current original pixel of the original image, the method further comprises:

selecting the maximum grayscale value from the grayscale values of the fourth sub-pixels of the current original pixel and the adjacent original pixels to obtain the grayscale value of the fourth sub-pixel of the current sampled pixel; and setting the grayscale value of the fourth sub-pixel of the current sampled pixel as a grayscale value of the fourth sub-pixel of the current sampled pixel.

10. The method as claimed in claim 6, wherein the current original pixel and the current sampled pixel respectively comprises a first sub-pixel, a second sub-pixel, a third sub-pixel and a fourth sub-pixel arranged in sequence, the current sampled pixel comprises at least two sub-pixel sets, the sub-pixel of one of the sub-pixel sets is the current sub-pixel of the current sampled pixel, and the current original pixel corresponds to one sub-pixel set of the current sub-pixel contained by the current sampled pixel.

11. The method as claimed in claim 6, wherein the current original pixel and the current sampled pixel respectively comprises a first sub-pixel, a second sub-pixel, a third sub-pixel and a fourth sub-pixel arranged in sequence, wherein the first sub-pixel, the second sub-pixel, the third sub-pixel are base-color sub-pixels, the step of calculating the grayscale degrees of the base-color sub-pixel of the sub-pixels of the current original pixel further comprises:

calculating the grayscale degrees by the equations:

$$GL_{R_max}=\max\{|R_{i-1}-R_i|,|R_i-R_{i+1}|\}$$

$$GL_{G_max}=\max\{|G_{i-1}-G_i|,|G_i-G_{i+1}|\}$$

$$GL_{B_max}=\max\{|B_{i-1}-B_i|,|B_i-B_{i+1}|\}$$

wherein $G_i$, $G_i$, and $B_i$ respectively relates to the grayscale values of the first sub-pixel, the second sub-pixel, and the third sub-pixel of the current original pixel, $R_{i-1}$, $G_{i+1}$, and $B_{i-1}$ respectively relates to the grayscale values of the first sub-pixel, the second sub-pixel, and the third sub-pixel of the previous original pixel adjacent to the current original pixel, $R_{i+1}$, $G_{i+1}$, and $B_{i+1}$ respectively relates to the grayscale values of the first sub-pixel, the second sub-pixel, and the third sub-pixel of the next original pixel adjacent to the current original pixel, the $GL_{R_max}$, $GL_{G_max}$, $GL_{B_max}$ respectively relates to the grayscale degrees of the first sub-pixel, the second sub-pixel, and the third sub-pixel of the current original pixel;

the step of selecting the maximum grayscale degree from the grayscale degrees further comprises:

selecting the maximum grayscale degrees from the $GL_{R_max}$, $GL_{G_max}$, and $GL_{B_max}$ by the equation:

$$GL_{C_max}=\max\{GL_{R_max},GL_{G_max},GL_{B_max}\}$$

wherein $GL_{C_max}$ relates to the maximum grayscale degree.

12. The method as claimed in claim 11, wherein the step of determining a plurality of weighted factors corresponding to the current sampled pixel of the sampled image in accordance with the maximum grayscale degree further comprises:

defining a parameter $k=GL_{C_max}\in[0,255]$;

calculating five weighted factors $w_1$, $w_2$, $w_3$, $w_4$, $w_5$ corresponding to the current sampled pixel by the equations below:

$$w_1=\lambda_1*f(x)$$

$$w_2=\lambda_2*f(x)$$

$$w_3=\lambda_3*f(x)$$

$$w_4=\lambda_4*f(x)$$

$$w_5=\lambda_5*f(x)$$

wherein $f(x)=ax^3+bx^2+cx+d$, $x=k/255\in[0,1]$, a, b, c, and d are fitting coefficients of f(x), and $\lambda_1$, $\lambda_2$, $\lambda_3$, $\lambda_4$, and $\lambda_5$ are weight distribution coefficients;

the step of calculating a weighted sum of grayscale values of the base-color sub-pixels of the current original pixel and the adjacent original pixels by the weighted factors to obtain the grayscale values of the base-color sub-pixels of the current sub-pixel of the current sampled pixel further comprises:

obtaining the grayscale values of the base-color sub-pixels of the current sub-pixel of the current sampled pixel by the equation:

$$h_o=w_1*h_{i-2}+w_2*h_{i-1}+w_3*h_i+w_4*h_{i+1}+w_5*h_{i+2};$$

wherein $h_o$ relates to the grayscale value of the base-color sub-pixel of the current sub-pixel of the current sampled pixel, $h_i$ relates to the grayscale value of the base-color sub-pixel of the current original pixel, $h_{i-2}$ and $h_{i-1}$ relates to the grayscale values of the base-color sub-pixels of the two previous original pixels adjacent to the current original pixel, and $h_{i+1}$ and $h_{i-2}$ relates to the grayscale values of the base-color sub-pixels of the two next original pixels adjacent to the current original pixel.

* * * * *